US010215362B2

(12) United States Patent
Nagahara et al.

(10) Patent No.: US 10,215,362 B2
(45) Date of Patent: Feb. 26, 2019

(54) LIGHT SOURCE APPARATUS WITH LENS ARRAY

(71) Applicant: NICHIA CORPORATION, Anan-shi, Tokushima (JP)

(72) Inventors: Seiji Nagahara, Yokohama (JP); Eiichiro Okahisa, Tokushima (JP)

(73) Assignee: NICHIA CORPORATION, Anan-Shi (JP)

( * ) Notice: Subject to any disclaimer, the term of this patent is extended or adjusted under 35 U.S.C. 154(b) by 162 days.

(21) Appl. No.: 14/979,832

(22) Filed: Dec. 28, 2015

(65) Prior Publication Data

US 2016/0186958 A1 Jun. 30, 2016

(30) Foreign Application Priority Data

Dec. 25, 2014 (JP) ..... 2014-261740

(51) Int. Cl.

| | |
|---|---|
| ***F21K 9/64*** | (2016.01) |
| ***F21V 5/00*** | (2018.01) |
| ***F21V 5/04*** | (2006.01) |
| ***F21Y 103/10*** | (2016.01) |
| ***F21Y 115/30*** | (2016.01) |

(52) U.S. Cl.

CPC ..... *F21V 5/04* (2013.01); *F21K 9/64* (2016.08); *F21V 5/007* (2013.01); *F21Y 2103/10* (2016.08); *F21Y 2115/30* (2016.08)

(58) Field of Classification Search

None

See application file for complete search history.

(56) References Cited

U.S. PATENT DOCUMENTS

| | | | | |
|---|---|---|---|---|
| 5,751,492 | A | 5/1998 | Meyers | |
| 7,310,186 | B2 * | 12/2007 | Lerner | G02B 27/0905 359/641 |
| 7,390,097 | B2 * | 6/2008 | Magarill | G02B 27/0905 353/38 |
| 8,310,762 | B2 * | 11/2012 | Yamamura | B29D 11/00298 359/455 |
| 8,328,390 | B2 * | 12/2012 | Marson | B29D 11/00278 362/244 |

(Continued)

FOREIGN PATENT DOCUMENTS

| | | | |
|---|---|---|---|
| JP | 10-084104 | A | 3/1998 |
| JP | 2006-171753 | A | 6/2006 |

(Continued)

*Primary Examiner* — Britt D Hanley

(74) *Attorney, Agent, or Firm* — Squire Patton Boggs (US) LLP

(57) ABSTRACT

A light source apparatus includes two or more light sources placed in one direction, and an array lens having two or more lenses, which corresponds to each of the light sources. In order to condense a light emitted from each of the lenses into one position, in a first lens in each of the lenses, an optical axis of the light source which corresponds to the first lens is shifted from an optical axis of said first lens in said one direction. The first lens is formed such that a length from the optical axis to one end of said first lens in the one direction is longer than a length from the optical axis to another end of the first lens in a direction which is opposite to the one direction.

14 Claims, 9 Drawing Sheets

(56) References Cited

U.S. PATENT DOCUMENTS

| | | | | |
|---|---|---|---|---|
| 8,371,706 | B2 * | 2/2013 | Takahashi | F21S 48/1145 362/293 |
| 8,733,993 | B2 * | 5/2014 | Takahashi | F21S 48/1145 362/516 |
| 8,746,923 | B2 * | 6/2014 | Ashdown | G02B 19/0066 362/240 |
| 2004/0114250 | A1 * | 6/2004 | Kato | G02B 3/0062 359/626 |
| 2006/0126185 | A1 | 6/2006 | Oh et al. | |
| 2007/0030676 | A1 * | 2/2007 | Ichihara | F21K 9/00 362/244 |
| 2008/0084693 | A1 * | 4/2008 | Shimada | F21S 8/026 362/240 |
| 2012/0057364 | A1 * | 3/2012 | Kishimoto | F21S 48/115 362/538 |
| 2012/0249972 | A1 | 10/2012 | Kurosaki | |
| 2013/0335989 | A1 * | 12/2013 | Sato | F21V 9/16 362/510 |
| 2015/0159829 | A1 * | 6/2015 | Joergensen | F21V 5/007 362/237 |
| 2015/0270682 | A1 * | 9/2015 | Daniels | H01S 5/405 353/99 |

FOREIGN PATENT DOCUMENTS

| | | | |
|---|---|---|---|
| JP | 2010-160343 | A | 7/2010 |
| JP | 2012-215633 | A | 11/2012 |
| JP | 2013-073079 | A | 4/2013 |

* cited by examiner

L6<L7

S1<S2<S3

L8<L9

S4<S5<S6

L101=L102
S101<S102<S103

LIGHT SOURCE APPARATUS WITH LENS ARRAY

CROSS-REFERENCE TO RELATED APPLICATIONS

The present application claims priority under 35 U.S.C. § 119 to Japanese Patent Application No. 2014-261740, filed on Dec. 25, 2014. The content of this application is incorporated herein by reference in their entirety.

BACKGROUND

Field

The disclosure relates to a light source apparatus which can be used in various applications such as a lighting equipment.

Description of the Related Art

Recently, a light source apparatus using a laser diode (LD) or a light emitting diode (LED) is proposed and put into practical use as a lighting equipment which can be applied to various applications such as a lighting equipment, a display, a projector and a backlight in the view point of reduction of power consumption, downsizing and design. Specifically, the laser diode can condense a light into a small area easily, and for example, a light source apparatus which can emit lights in various wavelengths with a high luminance can be realized by placing a phosphor at the light condensed position.

In this case, it is preferable to condense a plurality of lights emitted from a plurality of laser diodes into one position in order to increase a luminance. Accordingly, since a light emitted from the laser diode is a diverging light, there is used a configuration such that a diverging light emitted from each laser diode is converted into an approximately parallel light by a lens corresponding to each laser diode, and then the plurality of lights being approximately parallel are condensed by a condenser lens.

Further, as described in JP2013-73079A, in order to condense a light without using a condenser lens, there is also proposed a method where a plurality of lights emitted from a plurality of laser diodes are condensed into the same position by a placement such that an optical axis of the laser diode shifts from an optical axis (center) of the corresponding lens in the direction to be perpendicular to the optical axis of the corresponding lens.

In order to realize a light source apparatus in which both a high power and a downsizing are achieved at the same time, it is necessary to make narrower a distance between laser diodes and a distance between lenses corresponding to the laser diodes as well as increase the number of the laser diodes. In this case, in JP2013-73079A, since the optical axis of the laser diode shifts from the optical axis (center) of the corresponding lens, if a diverging angle of the light emitted from the laser diode becomes large, the light may enter a neighboring lens and may be emitted to an unexpected direction. Further, it may cause a stray light.

SUMMARY

A purpose of aspects of the present invention is to solve the above mentioned problem, and to provide a compact light source apparatus with a high power, which can condense lights emitted from two or more light sources without using a condenser lens, and even if a distance between each of the light sources and a distance between each of the lenses corresponding to each of the light sources are made narrower, a light emitted from the laser diode is not emitted to an unexpected direction.

One aspect of the light source apparatus according to the present invention is a light source apparatus, comprising two or more light sources placed in one direction. An array lens having two or more lenses is provided, which corresponds to each of the light sources. In order to condense a light emitted from each of the lenses into one position, in a first lens in each of the lenses, an optical axis of said light source which corresponds to the first lens shifts from an optical axis of the first lens in the one direction. The first lens is formed such that a length from the optical axis to one end of the first lens in the one direction is longer than a length from the optical axis to another end of the first lens in a direction which is opposite to the one direction.

According to certain embodiments of the present invention, it is possible to provide a compact light source apparatus with a high power, which can condense lights emitted from two or more light sources without using a condenser lens. Even if a distance between each of the light sources and a distance between each of the lenses corresponding to each of the light sources are made narrower, a light emitted from the laser diode is not emitted to an unexpected direction.

DETAILED DESCRIPTION

Figure 1A:
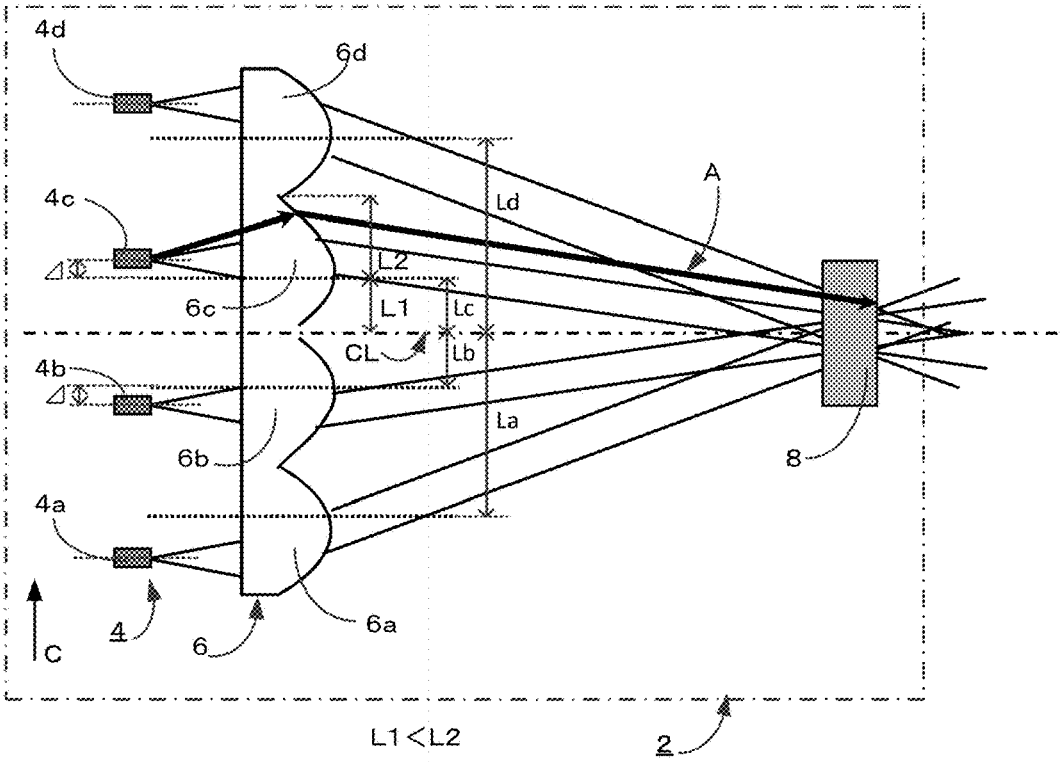
FIG. 1A illustrates an explanatory diagram (corresponding to a sectional view and a side view) for describing basic configuration of a light source apparatus according to an embodiment of the present invention.

According to certain embodiments of the invention, since the optical axis of the light source shifts from the optical axis of the lens, lights emitted from two or more light sources can be condensed without using a condenser lens. Further, in the one direction where the optical axis of the light source shifts from the optical axis of the lens, the first lens is formed such that the length from the optical axis to one end of the first lens is longer than the length from the optical axis to another end of said first lens in the opposite direction. Thus, the transmitting surface of the first lens is formed as extending to the offset direction (one direction) of the light source. Therefore, it is possible to provide a compact light source apparatus with a high power, in which even if a distance between each of the light sources and a distance between each of the lenses corresponding to each of the light sources are made narrower, the light emitted from the laser diode does not enter the neighboring lens and is not emitted to an unexpected direction, and thereby condensing a light emitted from the light source certainly.

According to certain embodiments, since the first lens and the second lens are formed continuously with a smooth curved surface, the array lens can easily be formed by the molding or the like, and it can provide the array lens having advantage in strength.

According to certain embodiments, since the optical axis of each of said lenses of the array lens is placed at the fixed interval, it can form an array lens with high accuracy easily and with a low manufacturing cost. Accordingly, it can easily provide a light source apparatus which can condense a light emitted from the light source certainly without using a condenser lens with a low manufacturing cost.

According to certain embodiments of the invention, since the optical axis of the light source is placed at the fixed interval, the light source apparatus ca be assembled easily. Accordingly, it can easily provide a light source apparatus which can condense a light emitted from the light source certainly without using a condenser lens with a low manufacturing cost.

Certain embodiments employ a lens with a curved surface, which can be a spherical surface or an aspheric surface. The lens is formed based on the same function which expresses such curved surface. "Based on the same function" means; in the case of the spherical surface, it is exemplified that a curvature (or a curvature radius) is the same, and in the case of the spherical surface, if the aspheric surface is expressed by polynomial equations including an equation of rotational two dimensional curve or a polynomial of the third degrees or more (for example, degrees in even number or odd number), it is exemplified that a curvature, a conic constant or an aspheric coefficient is the same.

According to this aspect, since the lens is formed based on the same function which expresses the curved surface, it can easily and certainly form the lens array in which the transmitting surface thereof has a desired curved shape extended smoothly to the offset direction (one direction) of the light source. Accordingly, it is possible to provide a light source apparatus with a high power, which can condense a light emitted from the light source without using a condenser lens certainly.

According to certain embodiments, since the phosphor is placed at the light condensed position of the light, it can emit a light in a desired wavelength by using a light emitted from the light source and a light in which the wavelength thereof is converted by the phosphor In certain embodiments, since the size of the phosphor is smaller than the size of the array lens, it can provided a compact light source apparatus with a high power which can emit a light in a desired wavelength.

In certain embodiments, since the phosphor emits a light in the wavelength of the complementary color to the light which enters the phosphor, the light source apparatus of this aspect can be provided as a white light source which can be used in various applications.

In certain embodiments, since the light path from the light source to the light condensed position of the emitted light is sealed, the light path is not infected by dirt, dust or the like, and it is possible to provide a light source apparatus which can maintain a high performance even if it is used for a long period.

In certain embodiments, being similar to other embodiments, since the transmitting surface of the first lens is formed to extend to the offset direction (one direction) of the light source, a distance between each of the light sources and a distance between each of the lenses corresponding to each of the light sources are made narrower, the light emitted from the laser diode does not enter the neighboring lens and is not emitted to an unexpected direction, and thereby condensing lights emitted from the light sources certainly.

Further, since the array lens has the first lens and the second lens, and the first lens and the second lens neighboring the first lens in the one direction are formed continuously, a compact light source apparatus can be realized. Accordingly, it can provide a compact light source apparatus with a high power.

In certain embodiments, since the first lens has the cut off portion of the surface in the direction opposite to the one direction, in spite of the compact array lens, it can certainly prevent a light emitted from the light source corresponding to the second lens from entering the first lens neighboring the second lens.

In certain embodiments, since the first lens and the second lens are formed continuously with the smooth curved surface, the array lens can easily be formed by the molding or the like, and it can provide the array lens having advantage in strength.

In the above and below discussion, while there is a description of "according to the aspect of the present invention, it is possible to condense lights emitted from two or more light sources without using a condenser lens", a light source apparatus having a condenser lens is also included in the present invention. For example, another condenser lens can be placed just after the array lens in the light traveling direction. The focal length can be made shorter by placing the condenser lens. Further, in this case, a condenser lens having a smaller size can be applied.

Next, a light source apparatus according to embodiments of the present invention will be described in detail with referring to the attached drawings.

Figure 1B:
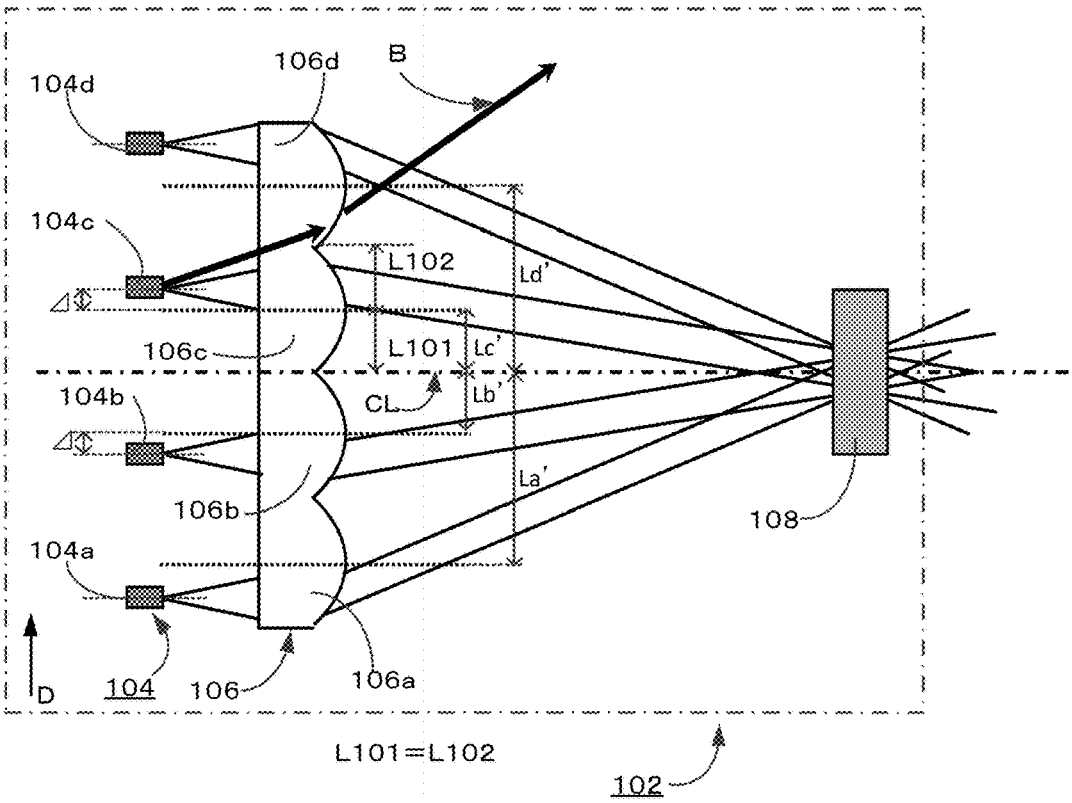
FIG. 1B illustrates an explanatory diagram (corresponding to a sectional view and a side view) for describing basic configuration of a light source apparatus as a comparative example.

At first, an outline of a light source apparatus according to the embodiment of the present invention is described with comparing the light source apparatus according to the embodiment of the present invention as show in FIG. 1A and a light source apparatus of the comparative example as illustrated in FIG. 2B. FIG. 1A illustrates an explanatory diagram (corresponding to a sectional view and a side view) for describing basic configuration of the light source apparatus according to the embodiment of the present invention. FIG. 1B illustrates an explanatory diagram (corresponding to a sectional view and a side view) for describing basic configuration of the light source apparatus as the comparative example. FIGS. 1A and 1B shows a direction of a light emitted from the light source schematically, and two lines indicate an outline of the light.

At first, common part in the light source apparatus according to the embodiment of the present invention and that of the comparative example is described. In the following description, a reference number of the light source apparatus according to the embodiment of the present invention as illustrated in FIG. 1A is described earlier and then a reference number of the light source apparatus of the comparative example as illustrated in FIG. 1B is described in a bracket.

A light source apparatus 2 (102) has a group of light sources 4 (104) which is formed by a plurality (four both in FIGS. 1A and 1B) of light sources 4*a* to 4*d* (104*a* to 104*d*) which are placed in a direction perpendicular to the optical axis thereof (refer to the Arrow C in FIG. 1A, the Arrow D in FIG. 1B), and an array lens 6 (106) into which lenses 6*a* to 6*d* (106*a* to 106*d*) corresponding to each of the light sources 4*a* to 4*d* (104*a* to 104*d*) are integrally formed. Optical axes of light sources 4*a* to 4*d* (104*a* to 104*d*) and optical axes of the corresponding lenses 6*a* to 6*d* (106*a* to 106*d*) are placed in parallel to each other.

As described in detail below, each of the light sources 4*a* to 4*d* (104*a* to 104*d*) is placed such that the optical axis thereof shifts from the optical axis of each of the corresponding lenses 6*a* to 6*d* (106*a* to 106*d*). Accordingly, it is possible to condense a light into one position without using a condenser lens. A phosphor 8 (108) is placed at a condensed position of a light emitted from the light source.

According to this configuration, for example, if the group of the light sources 4 (104) is formed by the light sources which emits a blue light, and the phosphor 8 (108) emits a yellow light which is a complementary color to the blue color when the blue light enters the phosphor 8 (108), the blue light and the yellow light are mixed, and therefore the light source apparatus 2 (102) can emit a white light. Accordingly, the light source apparatus 2 (102) can be used as a white light source.

In the light source apparatus 2 (102) as illustrated in FIGS. 1A, 1B, each of the optical axes of the light sources 4*a* to 4*d* (104*a* to 104*d*) shifts from the optical axis (that is, a center) of each of the corresponding lenses 6*a* to 6*d* (106*a* to 106*d*) in the direction perpendicular to the optical axis of the lens in order to condense a light without using a condenser lens.

For example, in the case of light source 4*c* (104*c*) and the lens 6*c* (106*c*) corresponding to the light source 4*c* (104*c*), the optical axis of the light source 4*c* (104*c*) shifts from the optical axis of the corresponding lens 6*c* (106*c*) with the offset amount Δ in the direction as indicated by the Arrow C (Arrow D) which is perpendicular to the optical axis (this offset direction of the light source can be called "one direction").

Similarly, relating to the others, the light sources 4*a* (104*a*), 4*b* (104*b*) and 4*d* (104*d*) also shift from the corresponding lenses 6*a* (106*a*), 6*b* (106*b*) and 6*d* (106*d*) respectively with predetermined offset amounts in the direction perpendicular to the optical axes thereof.

In more detail, a light is condensed to the center of the four light sources 4*a* to 4*d* (106*a* to 106*d*) in the line, that is, at the position between the light source 4*b* and 4*c* (104*b* and 104*c*). The light sources 4*b*, 4*a* (104*b*, 104*a*) and the light sources 4*c*, 4*d* (104*c*, 104*d*) are respectively placed symmetrically to the center line CL which passes the light condensed position and is parallel to the optical axis. The optical axis of each of the light sources 4*a* to 4*d* (104*a* to 104*d*) is placed at the farther (outside) position to the center line CL than the optical axis of each of the corresponding lenses 6*a* to 6*d* (106*a* to 106*d*).

Accordingly, in the light source 4*a*, 4*b* (104*a*, 104*b*), the opposite direction to the direction indicated by the Arrow C (Arrow D) is the offset direction of the light source, and in the light source 4*d* (104*d*), being similar to the light source

4*c* (104*c*), the direction directed by the Arrow C (Arrow D) is the offset direction of the light source.

In the embodiment shown in FIG. 1A, FIG. 1B, since the light sources are placed symmetrically to the center line CL, in the light sources which are placed closer (thus, inside) to the center line CL, the distance Lb (Lb') between the optical axis of the light source 4*b* (104*b*) and the center line CL is the same as the distance Lc (Lc') between the optical axis of the light source 4*c* (104*c*) and the center line CL. Similarly, in the light sources which are placed farther (thus, outside) to the center line CL, the distance La (La') between the optical axis of the light source 4*a* (104*a*) and the center line CL is the same as the distance Ld (Ld') between the optical axis of the light source 4*d* (104*d*) and the center line CL.

In the embodiment shown in FIGS. 1A, 1B, as the light source is placed farther from the center line, the offset amount thereof becomes larger. Thus, the offset amount of the light source 4*a* (104*a*) is larger than the offset amount of the light source 4*b* (104*b*), and the offset amount of the light source 4*d* (104*d*) is larger than the offset amount of the light source 4*c* (104*c*). The offset amounts of the light sources 4*b* and 4*c* (104*b* and 104*c*) are identical (=Δ), and the offset amounts of the light sources 4*a* and 4*d* (104 *a* and 104*d*) are identical. While the offset amounts of the light sources 4*a* and 4*d* (104*a* and 104*d*) are larger than Δ in this embodiment, it is not limited thereto, and they may be the same as Δ.

In the light source apparatus 102 as mentioned above, any of the lenses 106*a* to 106*d* of the array lens 106 which correspond to the light sources 104*a* to 104*d* has a shape in which a length from the optical axis to one end of the lens in the offset direction (one direction) of the light source which is perpendicular to the optical axis thereof is the same as a length from the optical axis to another end of the lens in the opposite direction. In FIG. 1B, if the lens 106*c* which corresponds to the light source 104*c* is exemplified, the length L102 from the optical axis to one end of the lens in the offset direction (one direction) is the same as the length L101 from the optical axis to another end of the lens in the opposite direction. Thus the lens is formed symmetrically to the optical axis thereof. In the other lenses 106*a*, 106*b* and *d*, the lens is also formed symmetrically to the optical axis thereof.

Generally, in order to provide a high power and a compactness for a light source apparatus, it is necessary to shorten a distance between light sources and a distance between lenses which correspond to the light source as well as to increase the number of the light sources. In this case, in the light source apparatus 102 of the comparative example as illustrated in FIG. 1B, although the optical axis of the light source shifts from the optical axis of the corresponding lens, the lens itself is formed symmetrically to the optical axis thereof. Therefore, if the light emitted from the light source 104*c* is exemplified, it is possible that the light emitted from the light source 104*c* enters the neighboring lens 106*d* instead of the corresponding lens 106*c*, and is emitted to the outward direction (an unexpected direction) which is opposite to the direction of the light condensed position, as indicated by the arrow B of FIG. 1B according to a diverging angle of the light emitted from the light source 104*c*. It may also cause a stray light.

In the light source apparatus 2 of the above mentioned configuration, each of the lenses 6*a* to 6*d* of the array lens 6 corresponding to the light sources 4*a* to 4*d* is formed such that a length from the optical axis to one end of the lens in the offset direction of the light source which is perpendicular to the optical axis thereof is longer than a length from the optical axis to another end of the lens in the opposite direction. In FIG. 1A, if the lens 1*c* which corresponds to the light source 4*c* is exemplified, the length L2 from the optical axis to one end of the lens in the offset direction (one direction) is longer than the length L1 from the optical axis to another end of the lens in the opposite direction. Thus the lens is formed asymmetrically to the optical axis thereof such that the transmitting surface of the lens is extended to the offset direction of the light source.

According to the shape of the lens 6*c*, if a light emitted from the light source 6*c* is exemplified, as illustrated in the Arroe A of FIG. 1A, it can certainly make the light enter the lens 6*c* without making the light enter the neighboring lens 6*d*.

Similarly, in the lenses 6*a*, 6*b* and 6*d*, a length from the optical axis to one end of the lens in the offset direction of the light source which is perpendicular to the optical axis thereof is longer than a length from the optical axis to another end of the lens in the opposite direction.

According to such configuration, the light source apparatus 2 of the embodiment of the present invention as illustrated in FIG. 1A, the transmitting surface of the lens is forms as extending to the offset direction (one direction) of the light source. Therefore, a light emitted from the laser diode does not enter the neighboring lens and certainly enters the corresponding lenses 6*a* to 6*d*.

Accordingly, the optical axis of the light source shifts from the optical axis of the lens, lights emitted from two or more light sources can be condensed without using a condenser lens. Further, it is possible to provide a compact light source apparatus with a high power, in which even if a distance between each of the light sources and a distance between each of the lenses corresponding to each of the light sources are made narrower, the light emitted from the laser diode does not enter the neighboring lens and is not emitted to an unexpected direction, and thereby condensing the light emitted from the light source certainly.

Figure 13A:
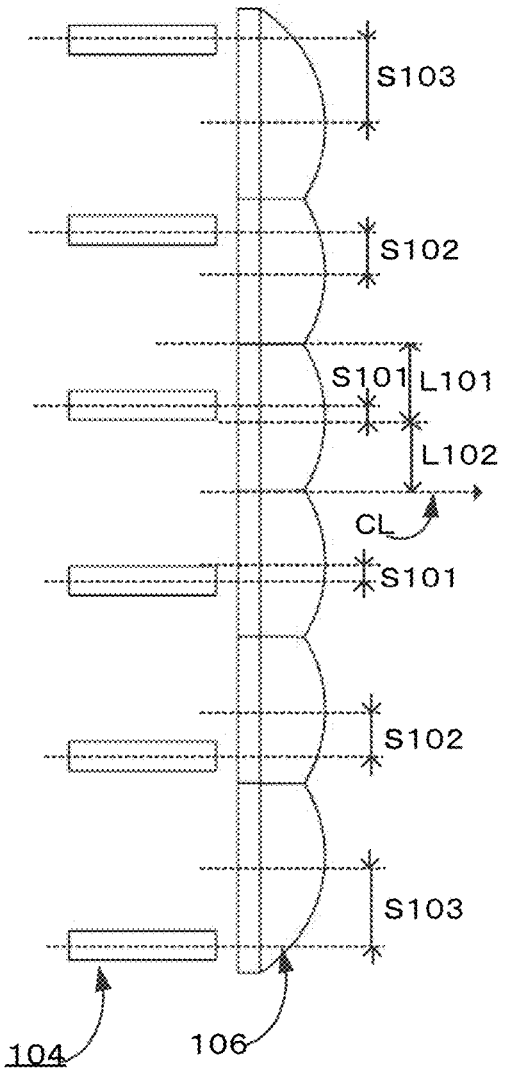
FIG. 13A illustrates an explanatory diagram (corresponding to a sectional view and a side view) for describing a placement of a light source and an array lens as a comparative example.
Figure 13B:
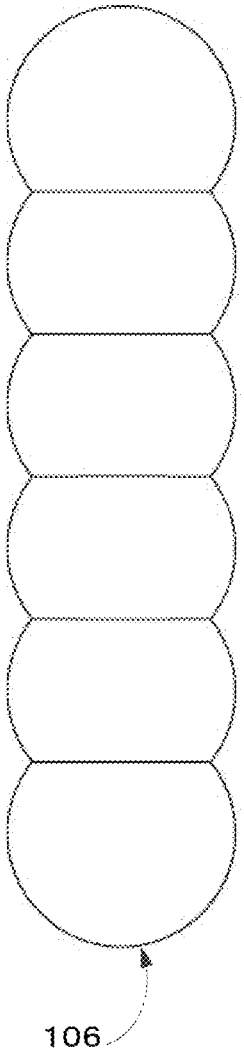
FIG. 13B illustrates an explanatory diagram (corresponding to a plan view) for describing a placement of a light source and an array lens as a comparative example.

In FIG. 1A, while the embodiment of array lens having the four light sources and the four corresponding lenses is illustrated, it is not limited thereto, and for example, FIGS. 8 and 9 illustrate embodiments having six light sources and six corresponding lenses. FIGS. 13A, 13B illustrate comparative examples of a lens array having six light sources and six corresponding lenses.

Relating to a light source used in a light source apparatus, while a laser diode (LD) is preferable because of compactness and a high power, it is not limited thereto, and for example, a light emitting diode (LED) can also be used. Such laser diode or light emitting diode is preferably a semiconductor chip.

A light in any wavelength range can be used as a wavelength of a light emitted from a light source. It is possible to use not only a light in a visible light range but also in an ultraviolet light range in order to raise a color rendering properties. For example, in the case of emitting a blue light, it is considered to emit a light in a wavelength range of 370 to 500 nm. Further it is preferable to emit a light in a wavelength range of 420 to 500 nm, and it is more preferable to emit a light in a wavelength range of 440 to 470 nm.

An array lens is a lens into which a plurality of lenses placed in a line or in a matrix are formed integrally. The array lens can be formed by any material as far as it is superior in translucency. For example, a glass material can be used, and a resin material can also be used as far as heat resistance is allowed. In manufacturing process, the array lens can be formed not only by molding but also by machining or the like. If the array lens is formed by molding, the array lens can be fabricated repeatedly by using the same mold once the mold is made, and thereby providing the array lens with low manufacturing cost.

As a curved surface of the lens which forms the array lens, a spherical surface or an aspheric surface can be considered. The lens according to the embodiment is formed based on the same function which expresses such curved surface. Thus, the transmitting surface of the lens is formed as extending to the offset direction (one direction) of the light source by using the same function which expresses such curved surface.

"Based on the same function" means; in the case of the spherical surface, it is exemplified that a curvature (or a curvature radius) is the same, and in the case of the spherical surface, if the aspheric surface is expressed by polynomial equations including an equation of rotational two dimensional curve or a polynomial of the third degrees or more (for example, degrees in even number or odd number), it is exemplified that a curvature, a conic constant or an aspheric coefficient is the same.

An example of the equation of rotational two dimensional curve and a polynomial equation with degrees in even number is shown below.

$$Z(s) = \frac{Cs^2}{1+\sqrt{1-(1+k)C^2s^2}} + A_4s^4 + A_6s^6 + A_8s^8 + \ldots \quad \text{Equation 1}$$

Z(s):

s: Sagging quantity (Distance from the optical axis)

C: Curvature k: Conic constant

An: Aspheric coefficient in n degrees

"Based on the same function" means that the curvature C, the conic constant k and the aspheric coefficient An are identical.

As mentioned above, since the lens is formed based on the same function which expresses the curved surface, it can easily and certainly form the lens array in which the transmitting surface thereof has a desired curved shape extended smoothly to the offset direction (one direction) of the light source. Accordingly, it is possible to provide a light source apparatus with a high power, which can condense lights emitted from the light sources without using a condenser lens certainly.

As a phosphor component according to the embodiment, it can use any phosphor component including a phosphor which emits a light in any wavelength range when a light in any wavelength range enters. For example, it is considered to use a phosphor component including a phosphor which emits a green light when a blue light enters, a phosphor which emits a yellow light when a blue light enters, or a phosphor which emits a red light when a blue light enters.

As a phosphor which emits a yellow light, a Yttrium, Aluminum, Garnet compound which is expressed in the chemical formula of $Y_3Al_3O_{12}$ is exemplified. By combining a light source which emits a blue light and this phosphor which emits a yellow light when a blue light enters, a compact light source apparatus with a high power which emits a white light can be realized.

Accordingly, if the phosphor component 8 emits a light in a wavelength of a complementary color to the light which enters the phosphor component 8, it is possible to provide the light source apparatus 2 according to the embodiment as a white light source which can be used in various applications.

As mentioned above, since the phosphor component 8 is placed at the light condensed position of the light emitted from each of the lenses of the array lens, it can emit a light in any desired wavelength by using a light from the light source and a light in a wavelength converted by the phosphor component 8.

As it is clear in FIG. 1A, a size of the phosphor component 8 is smaller than a size of the array lens 6, it is possible to provide a compact light source apparatus with a high power which can emit a light in a desired wavelength range.

The phosphor component can be in a fixed position, or it can be placed the rotating plate connected by a motor (thus, a phosphor wheel).

As mentioned above, in the embodiment of the present invention, the optical axis of the light source shifts from the optical axis of the lens in order to condense a light emitted from the light sources without using a condenser lens. Accordingly, in each of the lenses, the transmitting surface thereof is formed as extended to the offset direction (one direction) of the light source in order to make a light emitted from the light source enter the lens which corresponds to each of the light sources certainly.

If an offset amount of the light source becomes larger, it is possible to condense a light within a short distance in the optical direction. However, if the offset amount of the light source becomes larger, it is necessary to extend a transmitting surface of the lens further to the offset direction (one direction) accordingly. Therefore, a dimension of the light source in the direction which is perpendicular to the optical axis becomes larger.

A degree of the extension of the transmitting surface of the lens in the offset direction of the light source is affected by not only the offset amount of the light source but also a diverging angle of the light emitted from the light source and a distance between the light source and the lens. If the diverging angle is large, it is necessary to prolong a length of extension to the offset direction (one direction). If the length between the light source and the lens is long, it is necessary to prolong a length of extension to the offset direction (one direction). Therefore, it is necessary to determine the degree of the extension of the transmitting surface of the lens in the offset direction of the light source based on the offset amount, diverging angle, a distance between the light source and the lens in order to make a light emitted from the light source enter the transmitting surface of the corresponding lens certainly. Further, it is preferable to minimize the length in the above mentioned range, and thereby contributing downsizing of the light source apparatus.

Figure 2:
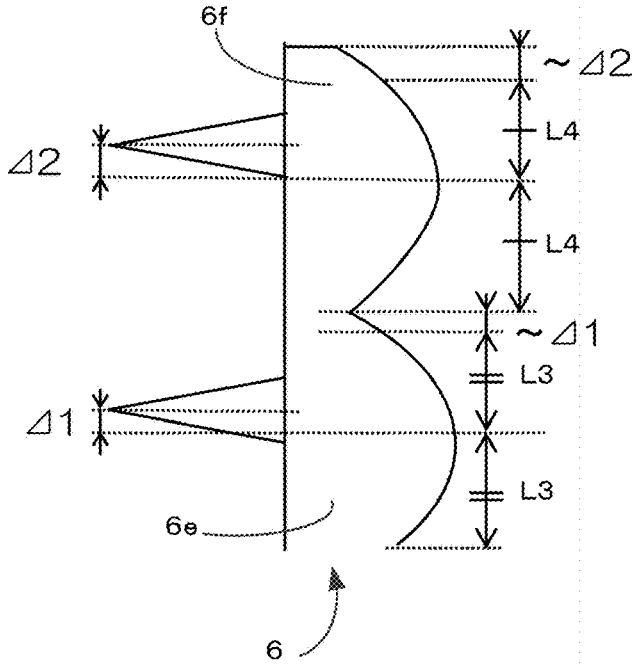
FIG. 2 illustrates an explanatory diagram (corresponding to a sectional view and a side view) for describing a single embodiment 1 for determining a length to extend a transmitting surface of the lens to an offset direction (one direction) of the light source.

Next, with referring to FIG. 2, in the array lens according to the embodiment of the present invention, a single embodiment 1 for determining a length to extend a transmitting surface of each of the lenses to the offset direction (one direction) of the light source is described. FIG. 2 illustrates an explanatory diagram (corresponding to a sectional view and a side view) for describing the single embodiment 1 for determining the length to extend the transmitting surface of the lens to the offset direction (one direction) of the light source.

A lens 6*e* which is placed at a central side (thus, a light condensed position side) of an array lens 6 and a lens 6*f* which is placed at the end of the array lens 6 are shown in FIG. 2. In the lens 6*e*, an optical axis of a light source (not shown, only a light emitted from the light source is shown in a line) which corresponds to the lens 6*e* shifts from an optical axis of the lens 6*e* by offset amount Δ1. In this case, if a distance from the optical axis to an end of the lens 6*e* in the direction which is opposite to the offset direction (one direction) is L3, a distance from the optical axis and the other end of the lens 6*e* in the offset direction (one direction) of the light source is extended more than the length L3 by a length within the offset amount Δ1.

In this case, it is possible to determine a most suitable extension length according to the offset amount Δ1, a diverging angle, and a distance between the light source and the lens. If the diverging angle of a light emitted from the light source is relatively large, or the distance between the light source and the lens is relatively long, it is preferable to extend the transmitting surface of the lens by a length which is almost the same as the offset amount Δ1. However, the embodiment shown in FIG. 2 is only one example. According to the diverging angle of a light emitted from the light source or the distance between the light source and the lens, it is not limited to extending by the length within the offset amount Δ1, but the transmitting surface of the lens can be extended by any arbitrary length as far as with considering downsizing of the light source apparatus.

In the lens 6*f* which is placed at the end of the array lens 6, an optical axis of a light source which corresponds to the lens 6*f* shifts from an optical axis of the lens 6*f* by an offset amount Δ2. In this case, if a distance from the optical axis to an end of the lens 6*f* in the direction which is opposite to the offset direction (one direction) is L4, a distance from the optical axis to the other end of the lens 6*f* in the offset direction (one direction) of the light source is extended more than the length L4 by a length within the offset amount Δ2.

Since the lens 6*f* is placed at the end of the array lens 6, the end of the lens 6*f*, thus the end of the array lens 6 is cut at the position extended by the length within the offset amount Δ2. Alternatively, it is possible to extend the array lens 6 along the transmitting surface of the lens 6*f* without cutting the lens 6*f* (array lens 6) at the position extended by the length within the offset amount Δ2.

Figure 3:
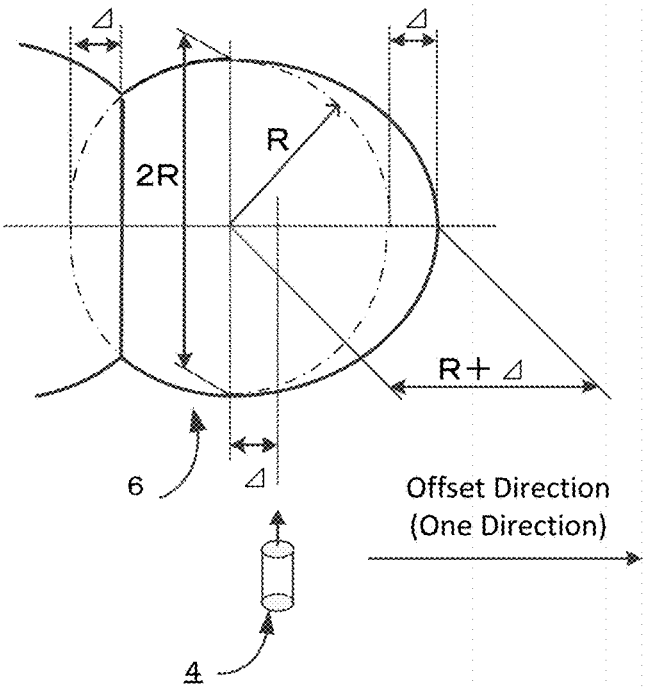
FIG. 3 illustrates an explanatory diagram (corresponding to a sectional view and a side view) for describing a single embodiment 2 for determining a length to extend a transmitting surface of the lens to an offset direction (one direction) of the light source.

Next, with referring to FIG. 3, in the array lens according to the embodiment of the present invention, a single embodiment 2 for determining a length to extend a transmitting surface of each of the lenses to the offset direction (one direction) of the light source is described. FIG. 3 illustrates an explanatory diagram (corresponding to a sectional view and a side view) for describing the single embodiment 2 for determining the length to extend the transmitting surface of the lens to the offset direction (one direction) of the light source.

In this embodiment, based on a length between the optical axis and an end of the lens in the direction which is perpendicular to the offset direction (one direction) of the light source, which is the up and down direction in FIG. 3, the length to extend the transmitting surface of the lens in the offset direction (one direction) of the light source is determined.

As clearly illustrated in FIG. 3, the light source (shown schematically) shifts from the optical axis of the lens by the offset amount A. The lens shown in FIG. 3 has a shape in which the transmitting surface of the lens is extended in the offset direction (one direction) of the light source in the lens having a circular shape with a radius R in a plan view. Thus, the lens is formed such that the length from the optical axis to the end of the lens in the offset direction (one direction) is longer than the length R from the optical axis to the end of the lens in the direction which is perpendicular to the offset direction (one direction).

In this embodiment, the lens has a shape configured to be extended by the offset amount Δ, as an extension length, more than the length R from the optical axis to the end of the lens in the direction which is perpendicular to the offset direction (one direction). Thus, the length from the optical axis to the end of the lens in the offset direction (one direction) becomes R+Δ.

Accordingly, since the length from the optical axis to the end of the lens in the offset direction (one direction) is longer than the length R from the optical axis to the end of the lens in the direction which is perpendicular to the offset direction (one direction) by the length Δ which corresponds to the offset amount from the optical axis of the lens, an array lens having an efficient lens shape can be formed as well as it can make a light emitted from the light source enter the lens which corresponds to the light source certainly, and thereby contributing downsizing of the light source apparatus.

It is also possible to make a length from the optical position to the end of the lens in the direction which is opposite to the offset direction (one direction) shorter than the length R from the optical axis to the end of the lens in the direction which is perpendicular to the offset direction by the offset amount Δ. Thus, it is possible to make the length from the optical axis to the end of the lens in the direction which is opposite to the offset direction (one direction) R−Δ.

In the above mentioned embodiment, while the length from the optical axis to the end of the lens is made longer or shorter than the length R by the offset amount Δ, it is not limited thereto, and it is also possible to make the length from the optical axis to the end of the lens is made longer or shorter than the length R by any length within the offset amount Δ. Further, according to the diverging angle and the distance between the light source and the lens, it is also possible to make the length from the optical axis to the end of the lens is made longer or shorter than the length R by any length exceeding the offset amount Δ.

Figure 4:
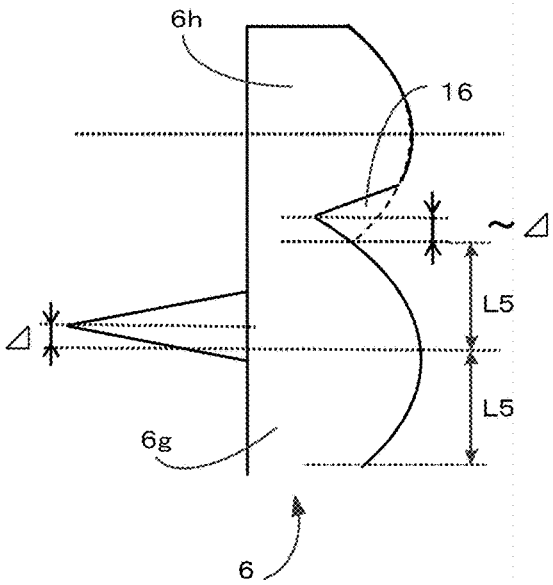
FIG. 4 illustrates an explanatory diagram (corresponding to a sectional view and a side view) for describing an array lens according to single embodiment 1 of the present invention.

Next, with referring to FIG. 4, a lens array according to the single embodiment 1 of the present invention is described. FIG. 4 illustrates an explanatory diagram (corresponding to a sectional view and a side view) for describing an array lens according to a single embodiment 1 of the present invention.

A lens 6*g* which is placed at a central side (thus, a light condensed position side) of an array lens 6 and a lens 6*h* which is placed at an end of the array lens 6 are shown in FIG. 4. In the lens 6*g*, an optical axis of a light source (not shown, only a light emitted from the light source is shown in a line) which corresponds to the lens 6*g* shifts from an optical axis of the lens 6*g* by an offset amount Δ. In this case, if a length from the optical axis to an end of the lens in the direction which is opposite to the offset direction (one direction) is L5, a transmitting surface of the lens 6*g* is extended such that it is longer than the length L5 by a length within the offset amount Δ.

In this case, in the extended portion by the length within the offset amount A, a lens surface of the neighboring lens 6*h* is formed such that some portion thereof is cut off. Thus, a cut off portion 16 is formed in order to avoid an adverse impact to the extended transmitting surface of the lens 6*g*. There is illustrated a virtual transmitting surface of the lens 6*h* by presuming that the cut off portion 16 is not formed by a dotted line in FIG. 4. Accordingly, it is possible to prevent a light emitted from the light source which corresponds to the lens 6*g* from entering the neighboring lens 6*h* certainly. The cut off portion 16 is formed such that the portion which a light emitted from the light source which corresponds to lens 6*h* enters is not included.

In other words, it means that the transmitting surface of the lens 6*h* (second lens) neighboring the lens 6*g* (first lens) in the offset direction (one direction) is formed in the position which is farther from the optical axis of the lens 6g than the end of the lens 6g in the offset direction (one direction).

According to the above mentioned configuration, it is possible to prevent a light emitted from the light source which corresponds to the first lens from entering the neighboring second lens certainly, and thereby condensing a light emitted from the light source certainly.

Figure 5:
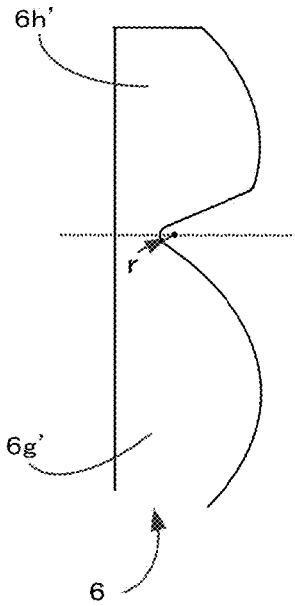
FIG. 5 illustrates an explanatory diagram (corresponding to a sectional view and a side view) for describing an array lens according to single embodiment 2 of the present invention.

Next, with referring to FIG. 5, a lens array according to the single embodiment 2 of the present invention is described. FIG. 5 illustrates an explanatory diagram (corresponding to a sectional view and a side view) for describing an array lens according to a single embodiment 2 of the present invention. In the single embodiment 2 as illustrated in FIG. 5, being similar to the embodiment as illustrated in FIG. 4, in a lens 6g' which is placed at a central side (thus, a light condensed position side) of an array lens 6 and a lens 6h' which is placed at an end of the array lens 6, the lens surface of the lens 6h' neighboring the lens 6g' is cut off in the portion in which the lens 6g' is extended.

At this moment, in the single embodiment 2, the lens 6g' (first lens) and the lens 6h' (second lens) are formed continuously with a smooth curved surface (refer to the radius r). As smooth curved surface, it can be a spherical surface, and any other curved surface which is an aspheric surface.

According to the above mentioned configuration, since the lens 6g' (first lens) and the lens 6h' (second lens) are formed continuously with a smooth curved surface, the array lens can easily be formed by the molding or the like, and it can provide the array lens having advantage in strength.

Figure 6:
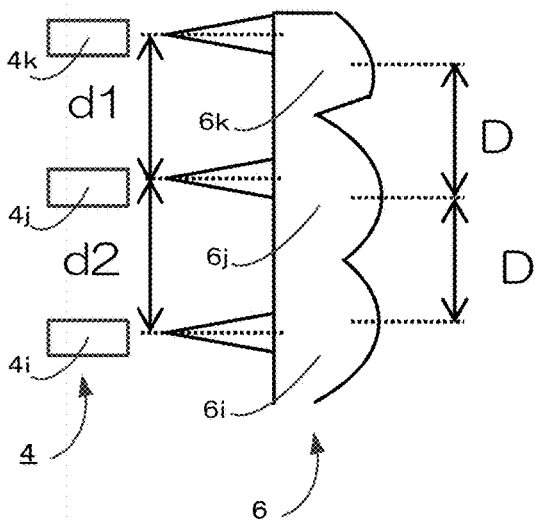
FIG. 6 illustrates an explanatory diagram (corresponding to a sectional view and a side view) for describing a placement of a light source and an array lens according to single embodiment 1 of the present invention.

Next, with referring to FIG. 6, a placement of a light source and a lens array according to the single embodiment 1 of the present invention is described. FIG. 6 illustrates an explanatory diagram (corresponding to a sectional view and a side view) for describing a placement of a light source and an array lens according to a single embodiment 1 of the present invention.

In the placement of the light source and the lens according to the single embodiment 1, each of the lenses 6i, 6j and 6k which form an array lens 6 is placed at a fixed interval D, and each of optical axes of light sources 4i, 4j and 4k which correspond to the lenses 6i, 6j and 6k respectively shifts from each of the optical axes of the lenses 6i, 6j and 6k. Therefore, in the same offset direction (one direction), if the offset amount is identical, a distance between each of the light sources becomes identical. If the offset amount is different, a distance between each of the light sources becomes different accordingly. Relating to each of offset amount between the optical axis of the light source and the optical axis of the lens, the same amount can be applied, and different amount can also be applied.

As mentioned above, since the optical axis of each of the lenses 6i to 6k of the array lens 6 is placed at the fixed interval D, it can form the array lens 6 with high accuracy easily and with a low manufacturing cost. Accordingly, it can easily provide a light source apparatus 2 which can condense a light emitted from the light source certainly without using a condenser lens with a low manufacturing cost.

Figure 7:
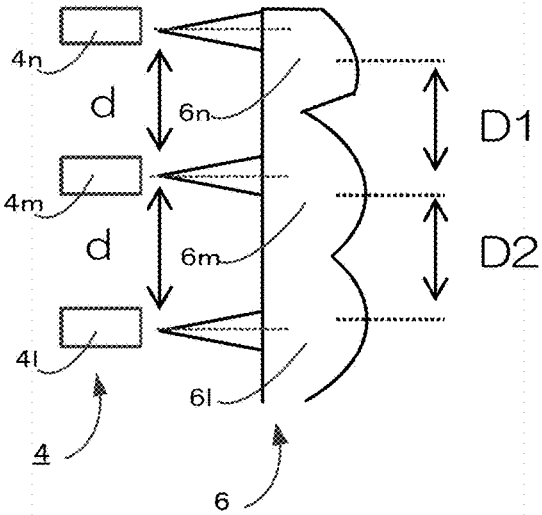
FIG. 7 illustrates an explanatory diagram (corresponding to a sectional view and a side view) for describing a placement of a light source and an array lens according to single embodiment 2 of the present invention.

Next, with referring to FIG. 7, a placement of a light source and a lens array according to the single embodiment 2 of the present invention is described. FIG. 7 illustrates an explanatory diagram (corresponding to a sectional view and a side view) for describing a placement of a light source and an array lens according to single embodiment 2 of the present invention.

In the placement of the light source and the lens according to the single embodiment 2 as illustrated in FIG. 7, each of optical axes of a plurality of light sources 4l to 4n is placed at the fixed interval d, and each of the optical axis of the light sources 4l to 4n shifts from each of optical axes of lenses 6l to 6n which correspond to the light source 4i to 4n respectively. Therefore, in the same offset direction (one direction), if the offset amount is identical. a distance between each of the lenses becomes identical. If the offset amount is different, a distance between each of the lenses becomes different accordingly. Relating to each of offset amount between the optical axis of the light source and the optical axis of the lens, the same amount can be applied, and different amount can also be applied.

As mentioned above, since each of the optical axes of the light sources 4l to 4n is placed at the fixed interval d, the light source apparatus can be assembled easily. Accordingly, it can easily provide a light source apparatus 2 which can condense a light emitted from the light source certainly without using a condenser lens with a low manufacturing cost.

According to this embodiment, while the distance between each of the optical axes of the lens 6l to 6n which form the array lens 6 is different, if the array lens is formed by molding, the array lens can be fabricated repeatedly by using the same mold once the mold is made, and thereby providing the array lens with low manufacturing cost.

Figure 8A:
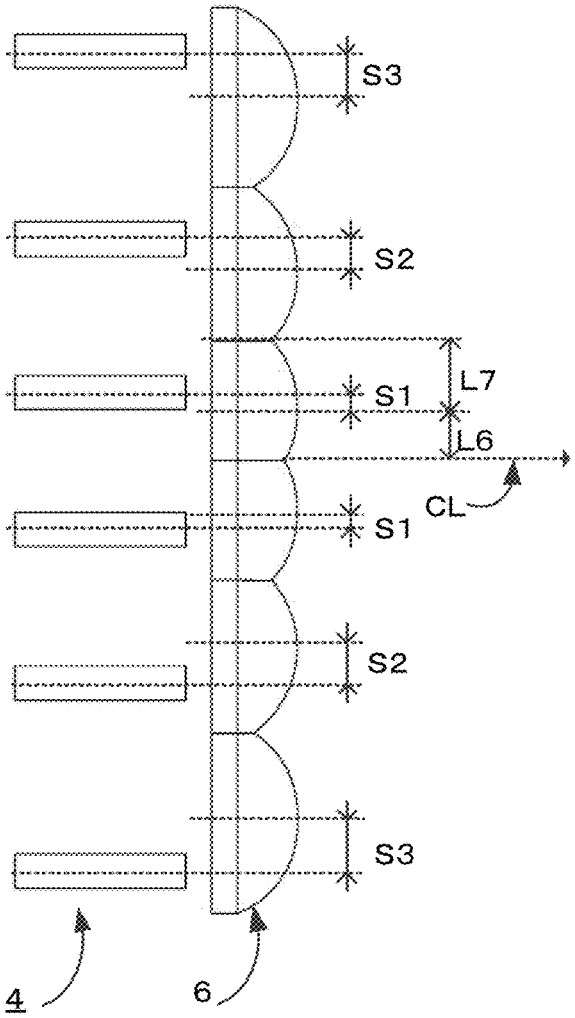
FIG. 8A illustrates an explanatory diagram (corresponding to a sectional view and a side view) for describing a placement of a light source and an array lens according to single embodiment 3 of the present invention.
Figure 8B:
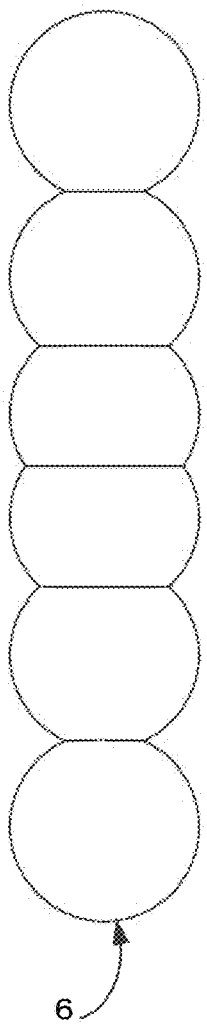
FIG. 8B illustrates an explanatory diagram (corresponding to a plan view) for describing a placement of a light source and an array lens according to single embodiment 3 of the present invention.

Next, with referring to FIGS. 8a, 8B, a placement of a light source and a lens array according to the single embodiment 3 of the present invention is described. FIG. 8A illustrates an explanatory diagram (corresponding to a sectional view and a side view) for describing the placement of the light source and the array lens according to the single embodiment 3 of the present invention. FIG. 8B illustrates an explanatory diagram (corresponding to a plan view) for describing the placement of the light source and the array lens according to the single embodiment 3 of the present invention.

In FIGS. 8a, 8B, a group of light sources 4 which is formed by six of the light sources and an array lens 6 which is formed by lenses which correspond to the light sources respectively are illustrated. In the placement of the group of light sources 4 and the array lens 6, optical axes of the light sources shifts from optical axes of the lenses which correspond to the light sources by offset amount of S1, S2 or S3. Each of the lenses has a shape such that a transmitting surface thereof is extended to the offset direction (one direction) of the light source by a length corresponding to the offset amount respectively. In this embodiment, a distance between each of the light sources and a distance between each of the lenses are not constant, and they are determined adequately according to the offset amount respectively.

When describing the placement of the group of light sources 4 and the array lens 6 in more detail, each of the light sources and each of the lenses are placed symmetrically to the center line CL which passes the light condensed position. The light sources and the lenses which located at the closest position to the center line CL shift to each other with the offset amount S1. The light sources and the lenses which located at the next closest position to the center line CL shift to each other with the offset amount S2. The light sources and the lenses which located at the farthest position to the center line CL shift to each other with the offset amount S3. In this case, there is a relationship such as S1<S2<S3.

Thus, as each of the lenses of the array lens is located farther from the light condensed position (center line CL), the offset amount between the optical axis of the light source and the optical axis of the lens which corresponds to the light source becomes larger.

As mentioned above, since as located farther from the light condensed position, the offset amount between the optical axis of the light source and the optical axis of the lens which corresponds to the light source becomes larger, it is possible to provide a light source apparatus which can condense a light emitted from the light source without using a condenser lens certainly.

Figure 9A:
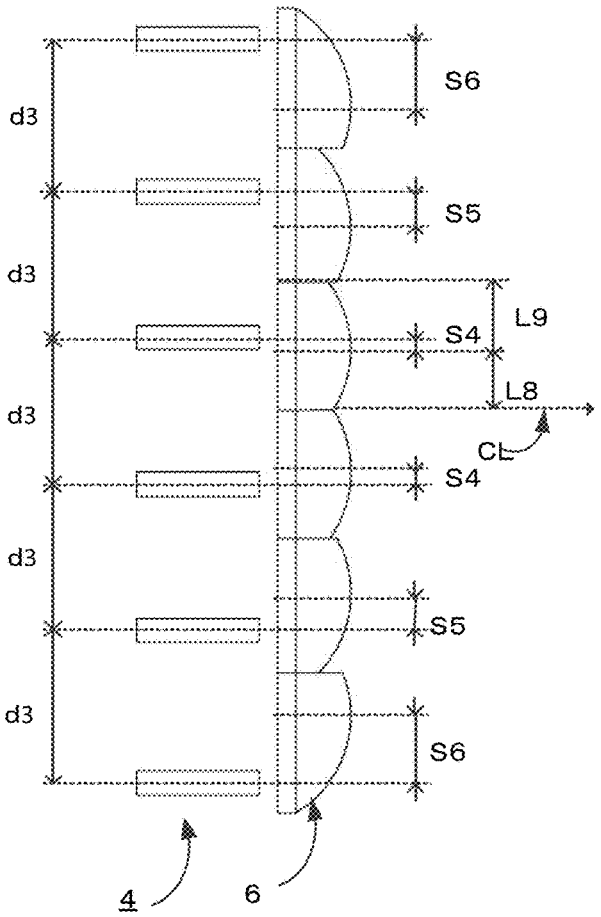
FIG. 9A illustrates an explanatory diagram (corresponding to a sectional view and a side view) for describing a placement of a light source and an array lens according to a single embodiment 3 of the present invention.
Figure 9B:
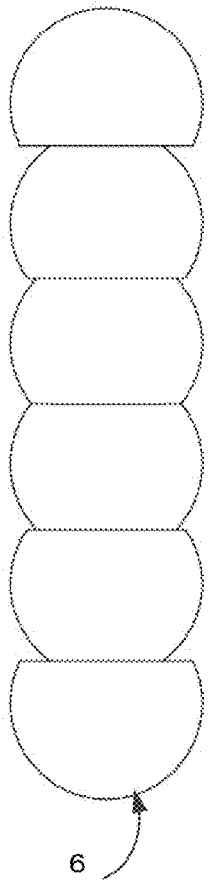
FIG. 9B illustrates an explanatory diagram (corresponding to a plan view) for describing a placement of a light source and an array lens according to single embodiment 3 of the present invention.

Next, with referring to FIGS. 9*a*, 9B, a placement of a light source and a lens array according to the single embodiment 3 of the present invention is described. FIG. 9A illustrates the explanatory diagram (corresponding to a sectional view and a side view) for describing the placement of the light source and the array lens according to the single embodiment 3 of the present invention. FIG. 9B illustrates an explanatory diagram (corresponding to a plan view) for describing the placement of the light source and the array lens according to the single embodiment 3 of the present invention.

In FIGS. 9*a*, 9B, a group of light sources 4 which is formed by six of the light sources and an array lens 6 which is formed by lenses which correspond to the light sources respectively are illustrated. In the placement of the group of light sources 4 and the array lens 6, each of the optical axes of the plurality of light sources is place at a fixed interval, and shifts from an optical axis of the lens which corresponds to the light source by offset amount of S4, S5 or S6. Each of the lenses has a shape such that a transmitting surface thereof is extended to the offset direction (one direction) of the light source by a length corresponding to the offset amount respectively. In this embodiment, since the optical axis of the light source is placed at the fixed interval, it can assemble the light source apparatus easily. Accordingly, it can easily provide a light source apparatus which can condense a light emitted from the light source certainly without using a condenser lens with a low manufacturing cost.

When describing the placement of the group of light sources 4 and the array lens 6 in more detail, as being similar to the embodiment shown in FIGS. 8*a*, 8B, each of the light sources and each of the lenses are placed symmetrically to the center line CL which passes the light condensed position. The light sources and the lenses which located at the closest position to the center line CL shift to each other with the offset amount S4. The light sources and the lenses which located at the next closest position to the center line CL shift to each other with the offset amount S5. The light sources and the lenses which located at the farthest position to the center line CL shift to each other with the offset amount S6. In this case, there is a relationship such as S4<S5<S6.

Thus, as each of the lenses of the array lens is located farther from the light condensed position (center line CL), the offset amount between the optical axis of the light source and the optical axis of the lens which corresponds to the light source becomes larger.

As mentioned above, since as located farther from the light condensed position, the offset amount between the optical axis of the light source and the optical axis of the lens which corresponds to the light source becomes larger, it is possible to provide a light source apparatus which can condense a light emitted from the light source without using a condenser lens certainly.

In FIGS. 13A, 13B, a placement of a light source and an array lens as a comparative example which corresponds to the case shown in FIGS. 9A, 9B is illustrated. As being similar to the case in FIGS. 9A, 9B, as each of the lenses of the array lens is located farther from the light condensed position (center line CL), the offset amount between the optical axis of the light source and the optical axis of the lens which corresponds to the light source becomes larger. However, since each of the lenses is formed symmetrically to the optical axis thereof, it is possible that a light emitted from the light source enters the neighboring lens instead of the corresponding lens, and is emitted to an unexpected direction which is different from the light condensed direction. It may also cause a stray light.

Next, a light source apparatus which has the light source and the array lens according to the embodiments of the present invention is described with referring to FIG. 10*a*-10D to FIGS. 12A-12D.

Figure 10A:
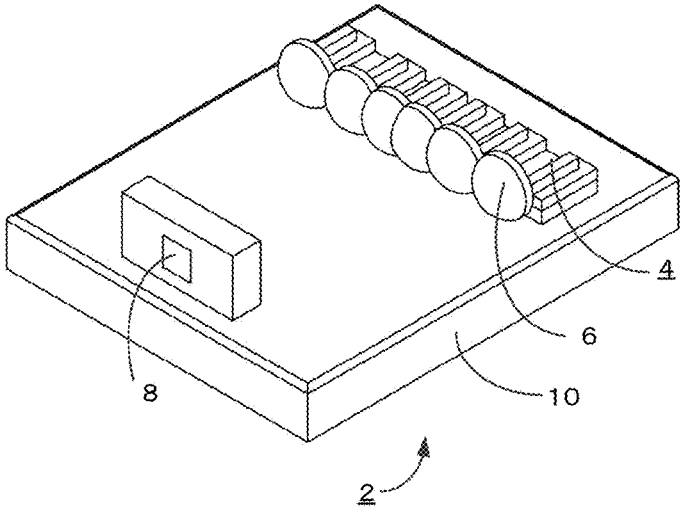
FIG. 10A illustrates a perspective view (without a cover) which schematically describes a light source apparatus according to single embodiment 1 of the present invention.
Figure 10B:
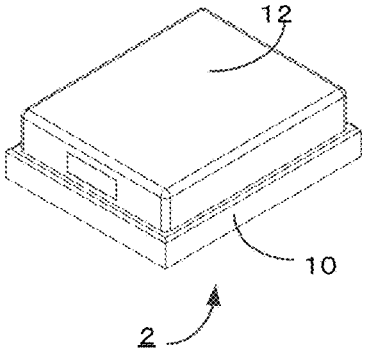
FIG. 10B illustrates a perspective view (enclosed in a cover) which schematically describes a light source apparatus according to single embodiment 1 of the present invention.
Figure 10C:
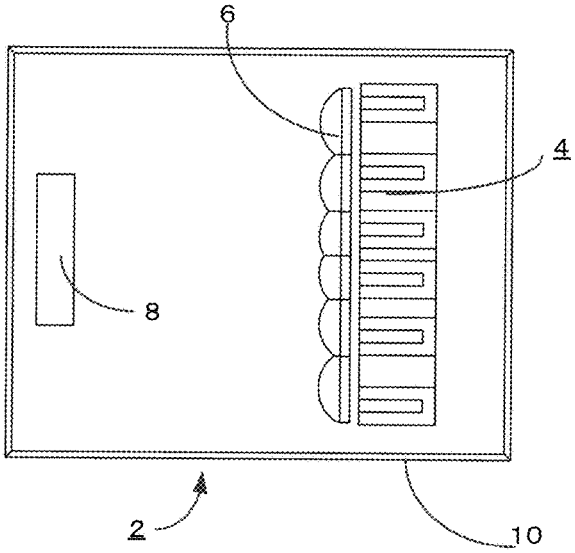
FIG. 10C illustrates a plan view (without a cover) which schematically describes a light source apparatus according to single embodiment 1 of the present invention.
Figure 10D:
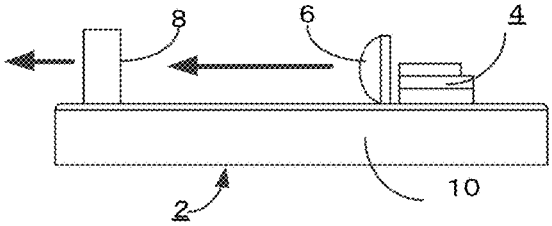
FIG. 10D illustrates a side view (without a cover) which schematically describes a light source apparatus according to single embodiment 1 of the present invention.

At first, with referring to FIGS. 10A to 10D, a light source apparatus according to single embodiment 1 of the present invention is described. FIG. 10A illustrates a perspective view (without a cover) which schematically describes the light source apparatus according to the single embodiment 1 of the present invention. FIG. 10B illustrates a perspective view (enclosed in a cover) which schematically describes the light source apparatus according to the single embodiment 1 of the present invention. FIG. 10C illustrates a plan view (without a cover) which schematically describes the light source apparatus according to the single embodiment 1 of the present invention. FIG. 10D illustrates a side view (without a cover) which schematically describes the light source apparatus according to the single embodiment 1 of the present invention.

As illustrated in FIG. 10A, in the light source apparatus 2 according to the embodiment, a group of light sources 4 which is formed by six of the light sources which are placed horizontally in a line, an array lens 6 which is formed by lenses which correspond to the light sources respectively and are placed horizontally in a line, and a phosphor component 8 which is located at a light condensed position into which a light emitted from the array lens 6 is condensed are installed on a substrate 10. In this embodiment, as illustrated by the arrow in the side view of FIG. 10D, a light is emitted from the group of light sources 4 to the horizontal one direction (right to left direction), and the light is condensed by each of the lenses of the array lens 6 and then enters the phosphor component 8. A mixed light of a light in the wavelength of the light emitted from the group of light sources 4 and a light in the wavelength converted by the phosphor component 8 is emitted in the horizontal direction (right to left direction). Accordingly, it is possible to provide a compact light source apparatus 2 with a high power.

Figure 11A:
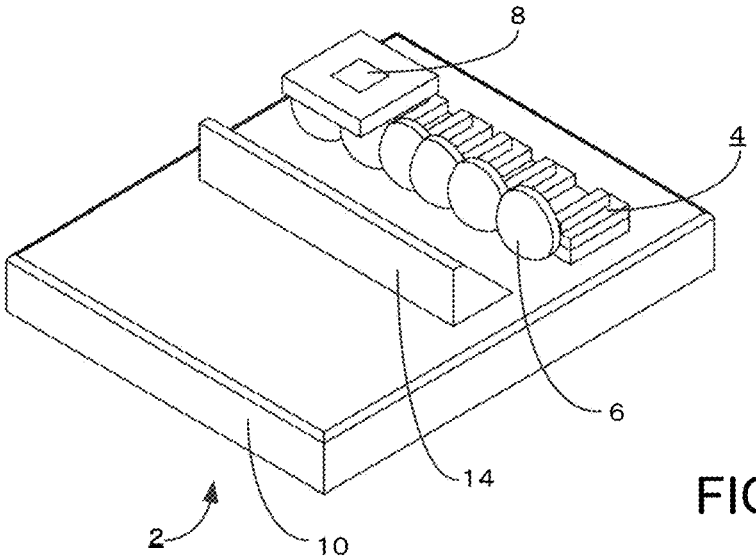
FIG. 11A illustrates a perspective view (without a cover) which schematically describes a light source apparatus according to single embodiment 2 of the present invention.
Figure 11B:
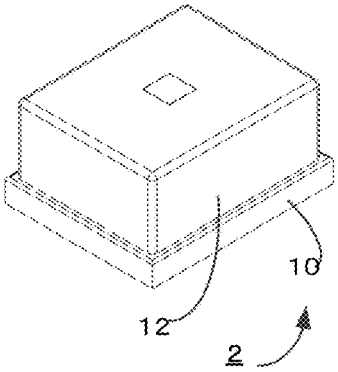
FIG. 11B illustrates a perspective view (enclosed in a cover) which schematically describes a light source apparatus according to single embodiment 2 of the present invention.
Figure 11C:
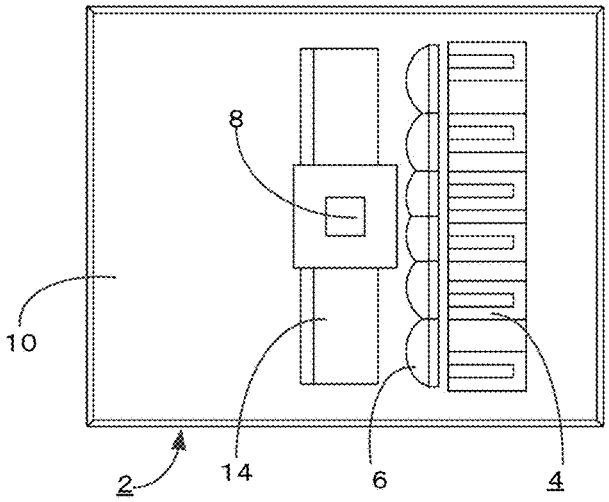
FIG. 11C illustrates a plan view (without a cover) which schematically describes a light source apparatus according to single embodiment 2 of the present invention.
Figure 11D:
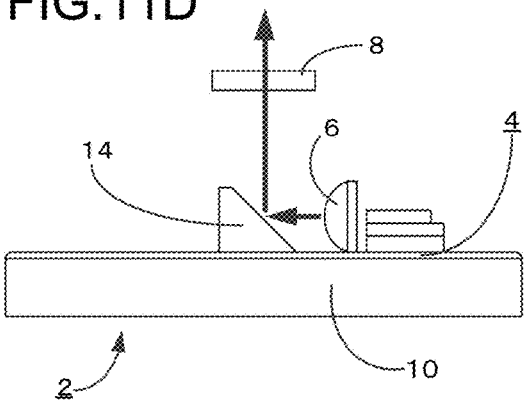
FIG. 11D illustrates a side view (without a cover) which schematically describes a light source apparatus according to single embodiment 2 of the present invention.

Next, with referring to FIGS. 11A to 11D, a light source apparatus according to single embodiment 2 of the present invention is described. FIG. 11A illustrates a perspective view (without a cover) which schematically describes the light source apparatus according to the single embodiment 2 of the present invention. FIG. 11B illustrates a perspective view (enclosed in a cover) which schematically describes the light source apparatus according to the single embodiment 2 of the present invention. FIG. 11C illustrates a plan view (without a cover) which schematically describes the light source apparatus according to the single embodiment 2 of the present invention. FIG. 11D illustrates a side view (without a cover) which schematically describes the light source apparatus according to the single embodiment 2 of the present invention.

As illustrated in FIG. 11A, in the light source apparatus 2 according to the embodiment, a group of light sources 4 which is formed by six of the light sources which are placed horizontally in a line, an array lens 6 which is formed by lenses which correspond to the light sources respectively and are placed horizontally in a line, a prism 14 which reflects a light emitted from the array lens 6, and a phosphor component 8 which is located above the prism 14 and also located at a light condensed position into which a light emitted from the array lens 6 is condensed are installed on a substrate 10. The phosphor component 8 is placed just above the prism 14 by a supporting component (not illustrated).

A point different from the above mentioned light source apparatus according to the single embodiment 1 is that a traveling direction of the light emitted horizontally from the light source is changed with 90 degrees by the prism 14 and then emitted in the upward direction.

Thus, as illustrated by the arrow in the side view of FIG. 11D, a light is emitted from the group of light sources 4 to the horizontal one direction (right to left direction), and the light is condensed by each of the lenses of the array lens 6. Then, the traveling direction of the light is changed with 90 degrees by the prism 14 and the light which is emitted in the upward direction enters the phosphor component 8. A mixed light of a light in the wavelength of the light emitted from the group of light sources 4 and a light in the wavelength converted by the phosphor component 8 is emitted vertically in the upward direction. Accordingly, it is possible to provide a light source apparatus 2 having a small thickness, and thereby achieving an efficient placement.

Figure 12A:
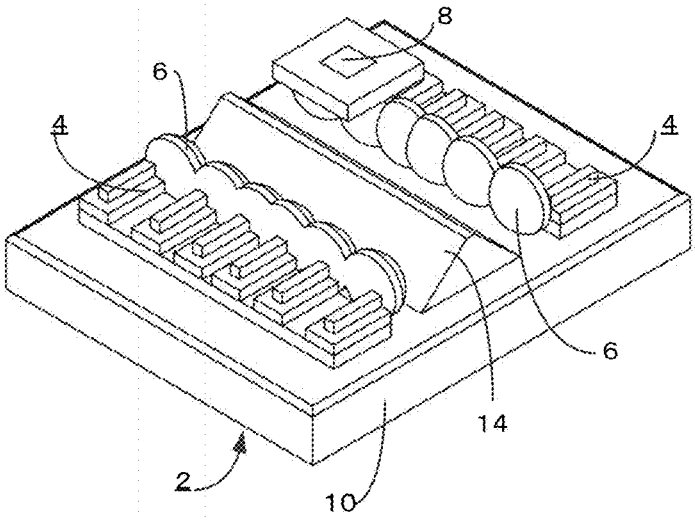
FIG. 12A illustrates a perspective view (without a cover) which schematically describes a light source apparatus according to single embodiment 3 of the present invention.
Figure 12B:
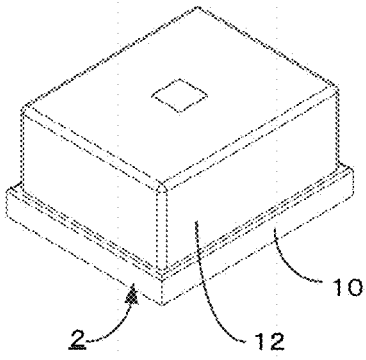
FIG. 12B illustrates a perspective view (enclosed in a cover) which schematically describes a light source apparatus according to single embodiment 3 of the present invention.
Figure 12C:
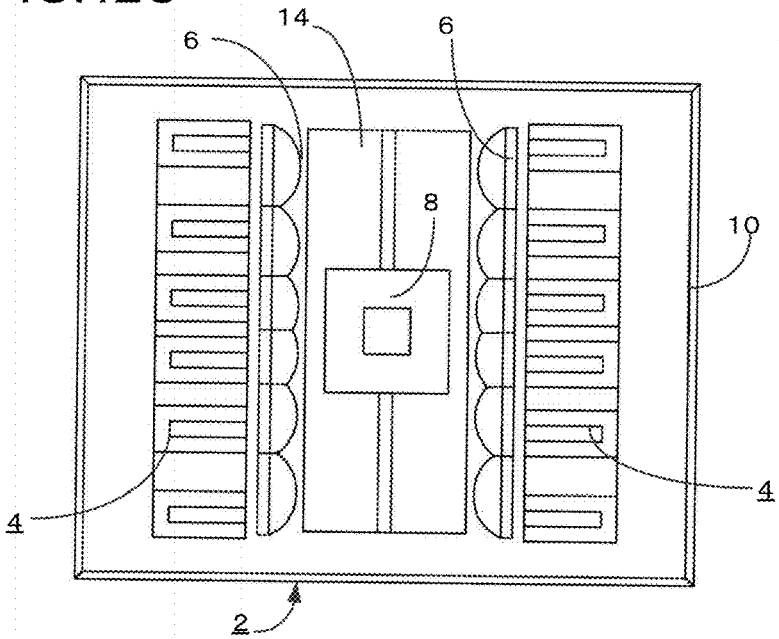
FIG. 12C illustrates a plan view (without a cover) which schematically describes a light source apparatus according to single embodiment 3 of the present invention.
Figure 12D:
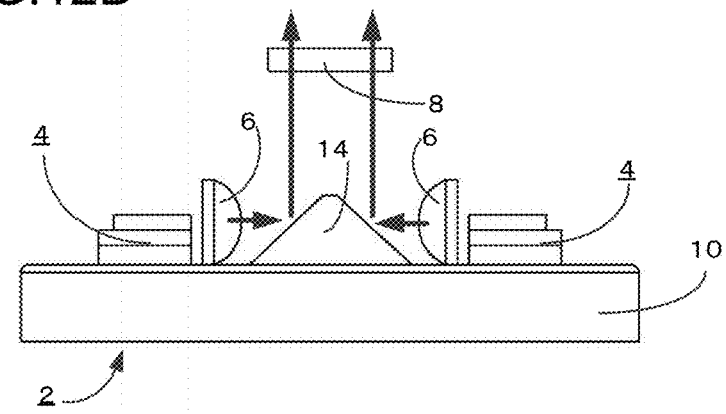
FIG. 12D illustrates a side view (without a cover) which schematically describes a light source apparatus according to single embodiment 3 of the present invention.

Next, with referring to FIGS. 12A to 12D, a light source apparatus according to a single embodiment 3 of the present invention is described. FIG. 12A illustrates a perspective view (without a cover) which schematically describes the light source apparatus according to the single embodiment 3 of the present invention. FIG. 12B illustrates a perspective view (enclosed in a cover) which schematically describes the light source apparatus according to the single embodiment 3 of the present invention. FIG. 12C illustrates a plan view (without a cover) which schematically describes the light source apparatus according to the single embodiment 3 of the present invention. FIG. 12D illustrates a side view (without a cover) which schematically describes the light source apparatus according to the single embodiment 3 of the present invention.

As illustrated in FIG. 12A, in the light source apparatus 2 according to the embodiment, as being similar to the light source apparatus according to the single embodiment 2 of the present invention, a traveling direction of the light emitted in the horizontal direction from the light source is change with 90 degrees by the prism 14, and then the light is emitted in the upward direction. A point different from the light source apparatus 2 according to the single embodiment 2 as illustrated in FIGS. 11A to 11D is that there are two pairs of light sources 4 and array lens 6 configured by a group of light sources 4 which is formed by six of the light sources, and an array lens 6 which is formed by lenses which correspond to the light sources respectively, and therefore, lights can enter the prism 14 in the horizontal direction from both sides.

When describing in more detail, as illustrated in FIG. 12D, two pairs of the group of light sources 4 and the array lens 6 are placed symmetrically to the center of the prism 14. As illustrated by the arrow in the side view of FIG. 12D, a light is emitted to the horizontal one direction (right to left direction) from the group of light sources 4 located at the right side, and the light is condensed by each of the lenses of the array lens 6. Then, the traveling direction of the light is changed with 90 degrees by the prism 14 and the light which is emitted in the upward direction enters the phosphor component 8. A mixed light of a light in the wavelength of the light emitted from the group of light sources 4 and a light in the wavelength converted by the phosphor component 8 is emitted vertically in the upward direction.

Similarly, a light is emitted to the horizontal one direction (left to right direction) from the group of light sources 4 located at the left side, and the light is condensed by each of the lenses of the array lens 6. Then, the traveling direction of the light is changed with 90 degrees by the prism 14 and the light which is emitted in the upward direction enters the phosphor component 8. A mixed light of a light in the wavelength of the light emitted from the group of light sources 4 and a light in the wavelength converted by the phosphor component 8 is emitted vertically in the upward direction. Accordingly, both of the lights emitted from the group of light sources 4 and the array lenses 6 located at the right side and left side are combined and then emitted. Therefore, it is possible to provide a light source apparatus with an efficient placement which has a high power in comparison with the size thereof.

While a traveling direction is change by using the prism 14, it is not limited thereto, and any other optical component which can change a traveling direction of a light such as a mirror is applicable. Further, a changed angle of the traveling direction of a light is not limited to 90 degrees, and it can be changed to any other angle according to applications or placements thereof.

As mentioned above, the light source apparatus is used under the condition as being enclosed by a cover 12 in any embodiment as illustrated in FIGS. 10A-10D to FIGS. 12A-12D. Therefore, since the light path from the light source to the light condensed position of the emitted light is sealed, the light path is protected from dirt, dust or the like, and it is possible to provide a light source apparatus which can maintain a high performance even if it is used for a long period.

In the descriptions of the above mentioned embodiments, while there is described "it is possible to condense lights emitted from two or more light sources without using a condenser lens", a light source apparatus having a condenser lens is also included in the present invention. For example, another condenser lens can be placed just after the array lens in the light traveling direction. The focal distance can be shortened by placing the condenser lens. Further, in this case, a condenser lens having a smaller size can be applied.

DESCRIPTION OF REFERENCE NUMBERS

2 Light Source Apparatus
4 Group of Light Sources
4*a* to 4*d* Light Source
6 Array Lens
6*a* to 6*j* Lens
8 Phosphor Component
10 Substrate
12 Cover
14 Prism
16 Cut Off Portion
102 Light Source Apparatus
104 Group of Light Sources
104*a* to 104*d* Light Source
106 Array Lens
106*a* to 106*d* Lens
108 Phosphor Component

What is claimed is:

1. A light source apparatus, comprising:

two or more light sources, wherein each of the two or more light sources is placed at a position to emit light in the same direction; and an array lens having two or more lenses, wherein each lens of the array lens corresponds to a corresponding one of said two or more light sources, wherein in order to condense a light emitted from each of said lenses into one position, in a first lens of the array lens, an optical axis of a corresponding light source of the first lens shifts from an optical axis of said first lens in an offset direction that is perpendicular to the optical axis of the corresponding light source of the first lens, wherein said first lens is formed such that a length from the optical axis of said first lens to one end of the first lens in said offset direction is longer than a length from the optical axis of said first lens to another end of said first lens in a direction which is opposite to said offset direction, wherein the optical axis of the corresponding light source of the first lens and the optical axis of the first lens are offset and parallel to each other, wherein a distance between the optical axis of the corresponding light source of the first lens and a center line of the array lens, is the same as a distance between an optical axis of a corresponding light source of a second lens neighboring the center line of the array lens and disposed at an opposite direction of the offset direction, and wherein the first lens and the second lens are disposed on opposite sides from the center line of the array lens.

2. The light source apparatus according to claim 1, wherein a surface which forms a third lens neighboring said first lens in said offset direction is located farther from the optical axis of said first lens than the one end of said first lens in said offset direction.

3. The light source apparatus according to claim 2, wherein said first lens and said third lens are formed continuously with a smooth curved surface.

4. The light source apparatus according to claim 1, wherein the optical axis of each of said lenses of said array lens is placed at a fixed interval, and the two or more light sources are placed such that the optical axes of the two or more light sources shift towards the optical axes of each lens of the array lens which corresponds to the corresponding one of said two or more light sources respectively.

5. The light source apparatus according to claim 1, wherein the optical axis of each of said two or more light sources is placed at a fixed interval, and each of the said lenses of said array lens is formed such that the optical axes of the two or more light sources shift towards the optical axes of each lens of the array lens which corresponds to the corresponding one of said two or more light sources respectively.

6. The light source apparatus according to claim 1, wherein each of said lenses of said array lens is formed based on a same function which expresses a curved surface.

7. The light source apparatus according to claim 1, wherein as a position becomes farther from a condensed position of a light emitted from each of said lenses of said array lens, an offset amount between the optical axes of said two or more light sources and said lens corresponding to said two or more light sources becomes larger.

8. The light source apparatus according to claim 1, wherein a phosphor is placed at a condensed position of a light emitted from each of said lenses of said array.

9. The light source apparatus according to claim 8, wherein a size of said phosphor is smaller than a size of said array lens.

10. The light source apparatus according to claim 8, wherein said phosphor emits a light in a wavelength of a complementary color to the light which enters said phosphor.

11. The light source apparatus according to claim 1, wherein a light path from said two or more light sources to a condensed position of a light emitted from said lens is sealed.

12. A light source apparatus, comprising:

two or more light sources, wherein each of the two or more light sources is placed at a position to emit light in the same direction; and an array lens having two or more lenses, wherein each lens of the array lens corresponds to a corresponding one of said two or more light sources, wherein in order to condense a light emitted from each of said lenses into one position, in a first lens of the array lens, an optical axis of a corresponding light source of the first lens shifts from an optical axis of said first lens in an offset direction that is perpendicular to the optical axis of the one of the two or more light sources, wherein said first lens is formed such that a length from the optical axis of said first lens to one end of the first lens in said offset direction is longer than a length from the optical axis of said first lens to another end of said first lens in a direction which is opposite to said offset direction, wherein said array lens has a second lens neighboring said first lens in said offset direction, and said first lens and said second lens are formed continuously such that the one end of the first lens is directly connected to an end of the second lens, and wherein the optical axis of the corresponding light source of the first lens and the optical axis of the first lens are offset and parallel to each other.

13. The light source apparatus according to claim 12, wherein said first lens has a cut off portion of the surface in the direction which is opposite to said offset direction.

14. The light source apparatus according to claim 13, wherein said first lens and said second lens are formed continuously with a smooth curved surface.

* * * * *